US005529181A

United States Patent [19]

Brier

[11] Patent Number: 5,529,181

[45] Date of Patent: Jun. 25, 1996

[54] GARMENT DISPLAY PACKAGE

[75] Inventor: Marci A. Brier, Huntersville, N.C.

[73] Assignee: Kemfast Sportsox, Inc., Lincolnton, N.C.

[21] Appl. No.: 382,438

[22] Filed: Feb. 2, 1995

[51] Int. Cl.[6] ..... B65D 85/18

[52] U.S. Cl. ..... 206/299; 206/294; 206/763; 229/117.18

[58] Field of Search ..... 206/44 R, 45.14, 206/45.31, 278, 292, 294, 296, 297, 299; 223/85; 229/117.18, 117.16, 162, 103.2

[56] References Cited

U.S. PATENT DOCUMENTS

| | | | |
|---|---|---|---|
| D. 83,437 | 2/1931 | Goldberg . | |
| D. 282,338 | 1/1986 | Putt | D7/76 |
| D. 306,696 | 3/1990 | Futter | D9/415 |
| D. 307,715 | 5/1990 | Kindler | D9/415 |
| D. 335,032 | 4/1993 | Durkin, III | D4/199 |
| 1,301,418 | 4/1919 | Frost . | |
| 1,690,883 | 11/1928 | Ziegler . | |
| 2,039,383 | 5/1936 | Blumenstock | 206/7 |
| 2,054,661 | 9/1936 | Reich | 229/87 |
| 2,757,791 | 8/1956 | Kendig | 206/46 |
| 2,917,163 | 12/1959 | Baker et al. | 206/299 X |
| 2,968,393 | 1/1961 | Phillips, Jr. | 206/299 X |
| 3,037,621 | 6/1962 | Jackman | 206/80 |
| 3,057,462 | 10/1962 | Rouder | 206/7 |
| 3,157,276 | 11/1964 | Haas, Jr. | 206/46 |
| 3,908,823 | 9/1975 | Smith | 206/45.14 X |
| 3,946,936 | 3/1976 | Brown | 229/38 |
| 4,257,522 | 3/1981 | Thorneburg | 206/299 |
| 4,344,533 | 8/1982 | Olsen | 229/117.18 X |
| 4,424,906 | 1/1984 | Richmond | 206/45.14 X |
| 4,450,961 | 5/1984 | Bies et al. | 206/349 |
| 4,457,431 | 7/1984 | Lundquist et al. | 229/117.18 X |
| 4,485,917 | 12/1984 | Smith | 206/278 |
| 4,512,464 | 4/1985 | Sylvester | 206/292 |
| 4,569,441 | 2/1986 | Inghirami | 206/292 |
| 4,601,417 | 7/1986 | Kunreuther | 223/85 |
| 4,948,036 | 8/1990 | Loughman | 229/117.18 X |
| 5,018,663 | 5/1991 | Corso | 229/162 X |
| 5,348,148 | 9/1994 | Lancaster | 206/288 |

*Primary Examiner*—Allan N. Shoap
*Assistant Examiner*—Christopher T. McDonald
*Attorney, Agent, or Firm*—W. Thad Adams, III

[57] ABSTRACT

A garment display package and method is provided. The package includes a web folded to define a bottom wall and spaced apart front and back walls for locating a garment therebetween. The bottom, front, and back walls collectively form a garment receiving opening having a width greater than its height. A hanger is located on a widthwise dimension of the back wall for hanging the package from a supporting structure for display.

19 Claims, 6 Drawing Sheets

GARMENT DISPLAY PACKAGE

TECHNICAL FIELD AND BACKGROUND OF THE INVENTION

This invention relates to a garment display package and method, and is most applicable for displaying socks and other hosiery products. The invention provides a laterally extending display which requires substantially less area than needed for displaying a like number of conventionally-packaged, vertically hung socks. The invention allows purchasers to view the socks and feel the socks prior to purchase without opening or damaging the package.

According to one prior art sock package (See FIG. 4), a back wall of the package has a height substantially greater than its width. A relatively small peg-receiving hole is formed in a widthwise dimension of the back wall near the top of the package for hanging the package vertically from a wire rack or peg board. The package further includes a front wall spaced-apart from the back wall, opposing side walls, and open top and bottom ends through which respective ends of the folded socks extend. The socks are folded near the heel in order to display a greater portion of the socks through the open top and bottom ends of the package.

The socks of the prior art package are intended to be displayed and merchandised primarily from the wire rack or peg board. Thus, since the package cannot be supported upright on a flat surface, it is generally ineffective for displaying socks on such as athletic shoes.

Unlike the prior art, the package of the present invention is self-merchandising-meaning that the package can be effectively displayed on either a flat surface or hung from a wire rack like the prior art. The present package allows purchasers to view and feel more of the socks without folding the socks at the heel in an effort to display a greater portion of the socks through the open ends of the package.

According to the present invention, the socks can be effectively displayed in the package with a fold slightly above the ankle of the socks. This reduces the length of the socks when folded, and results in more effective use of the display area. Test results show that the present package requires 24–27% less display area than the conventional, prior art package. A 10% increase of available display area allows a 50% increase in package facings.

SUMMARY OF THE INVENTION

Therefore, it is an object of the invention to provide a display package which is especially suited for displaying garments, such as socks.

It is another object of the invention to provide a display package which displays the socks laterally when hung from a wire rack or peg board.

It is another object of the invention to provide a display package for being placed on a flat surface, such as a display shelf or table.

It is another object of the invention to provide a display package which when displayed with a number of like packages requires between 20–30% less display area than conventional packages for displaying the same number of socks.

It is another object of the invention to provide a display package which allows a purchaser to view and feel a relatively large portion of the sock prior to purchase without opening or damaging the package.

It is another object of the invention to provide a display package which is self-merchandising.

It is another object of the invention to provide a display package which displays the socks in a use orientation.

It is another object of the invention to provide a method of displaying socks.

These and other objects of the present invention are achieved in the preferred embodiments disclosed below by providing a garment display package. The package includes a web folded to define a bottom wall and spaced apart front and back walls for locating a garment therebetween. The bottom, front, and back walls collectively form a garment receiving opening having a width greater than its height. A hanger is located on a widthwise dimension of the back wall for hanging the package from a supporting structure for display.

According to one preferred embodiment of the invention, the width of the garment receiving opening is at least twice as great as the height of the opening.

According to another preferred embodiment of the invention, the bottom, front, and back walls of the package define an open top and open sides.

According to yet another preferred embodiment of the invention, the back wall of the package extends above the front wall, and includes a reinforcing section for being handled by users.

According to yet another preferred embodiment of the invention, the front wall of the package defines at least one display window therein for providing further display of the garment in the package.

Preferably, the front wall of the package defines first and second laterally spaced display windows therein for providing further display of the garment in the package.

According to one preferred embodiment of the invention, the front wall of the package includes an enlarged center section located between the first and second display windows.

According to another preferred embodiment of the invention,, an anchor is secured to the center section of the front wall and to the back wall of the package for interconnecting the front and back walls of the package.

According to yet another preferred embodiment of the invention, the hanger includes a prong-receiving hole formed in the back wall of the package.

According to yet another preferred embodiment of the invention, the garment display package includes a web folded to define spaced apart front and back walls for locating a garment therebetween. The front and back walls form a garment receiving opening having a width greater than its height. A hanger is located on a widthwise dimension of the back wall for hanging the package from a supporting structure for display.

A sock display package includes a web folded to define a bottom wall, and spaced apart front and back walls for locating a sock therebetween. The bottom, front, and back walls collectively form a garment receiving opening having a width greater than its height, and spaced-apart open sides through which respective ends of the sock extend. The sock is arranged within the package in a use orientation with a heel and toe of the sock extending respectively through the open sides, and a sole of the sock residing adjacent to the bottom wall of the package.

An embodiment of the method according to the invention comprises the steps of placing the sock in a display package having a bottom wall, spaced-apart front and back walls, and open sides through which respective ends of the sock extend. The sock is arranged within the package in a use orientation for display. The heel and toe of the sock extend respectively through the open sides of the display package with a sole of the sock residing adjacent to the bottom wall of the package.

According to another preferred embodiment of the invention, the method includes the step of hanging the display package from a supporting structure for displaying the socks.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
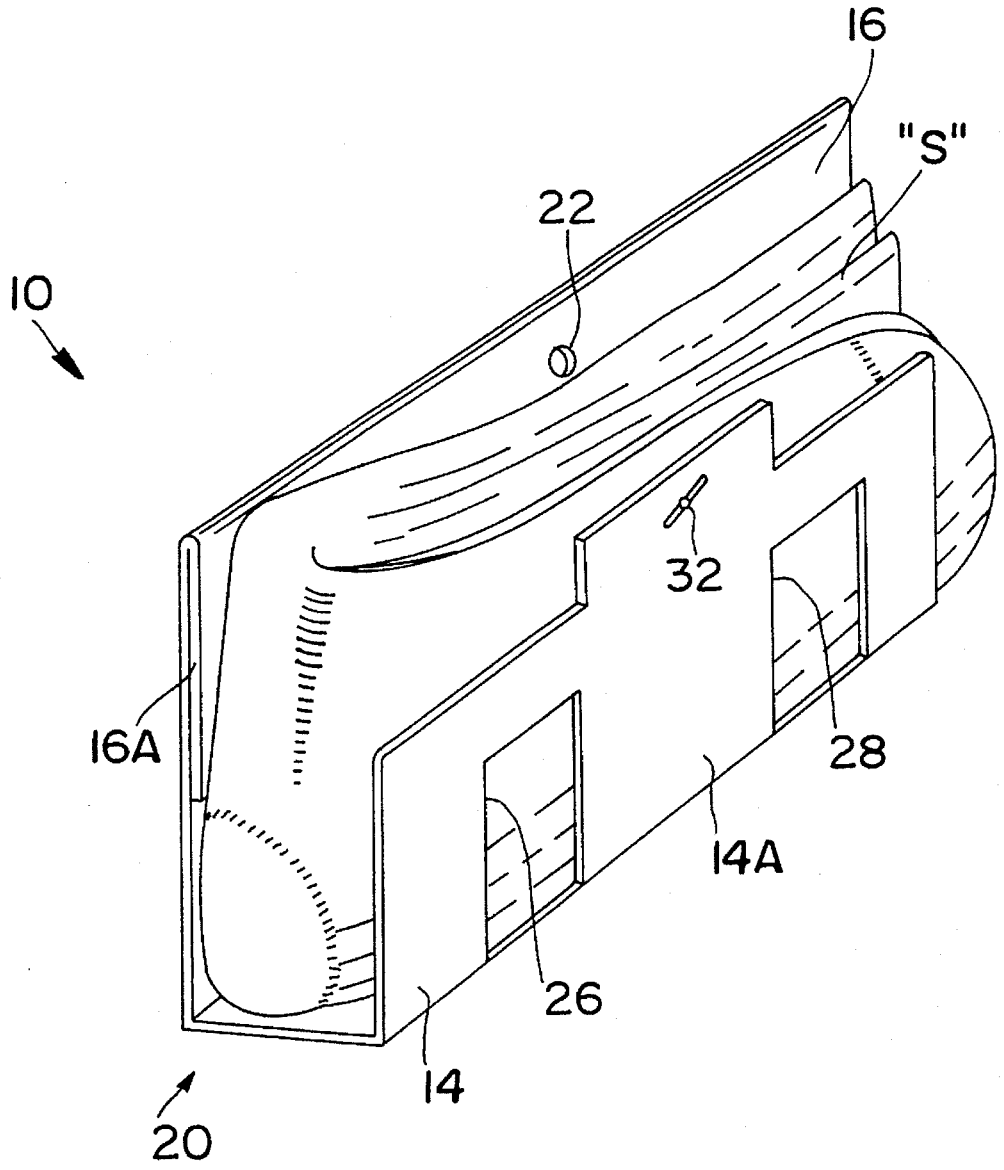
FIG. 1 is a perspective view of a garment display package according to one preferred embodiment of the invention, and showing a pair of socks located within the garment receiving opening.

Referring now specifically to the drawings, a garment display package according to one embodiment of the present invention is illustrated in FIG. 1 and shown generally at reference numeral 10. The package 10 is especially applicable for displaying socks "S" in a use orientation. The "use orientation" is defined herein as the position of the socks "S" within the package 10 wherein the heel and toe of the respective socks "S" are located at opposite ends of the package 10 with the soles of the socks "S" facing downwardly, as shown in FIG. 1. The package 10 thereby displays the socks "S" as they would be worn on the foot of the wearer.

Figure 2:
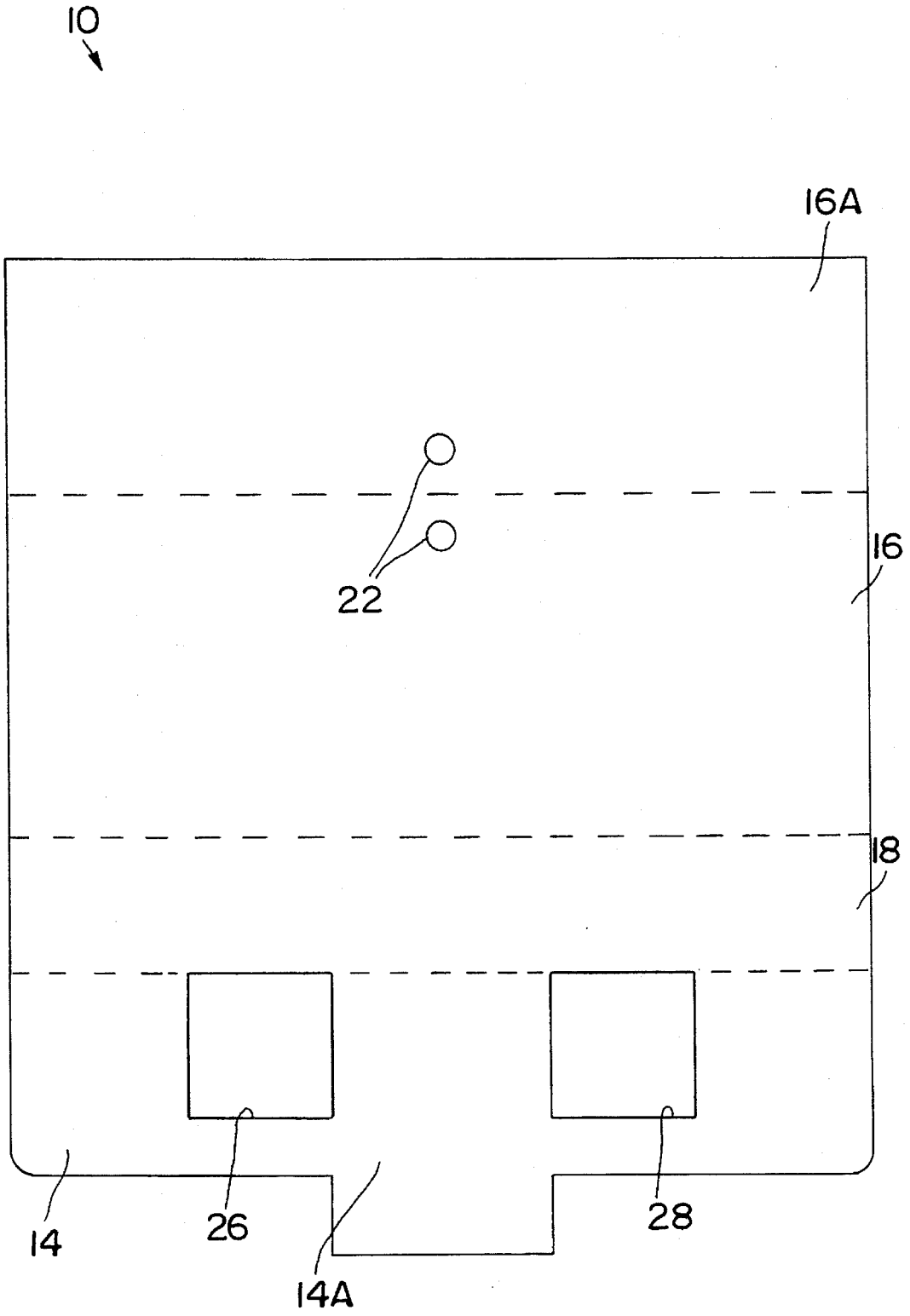
FIG. 2 is a plan view of the web prior to folding.
Figure 3:
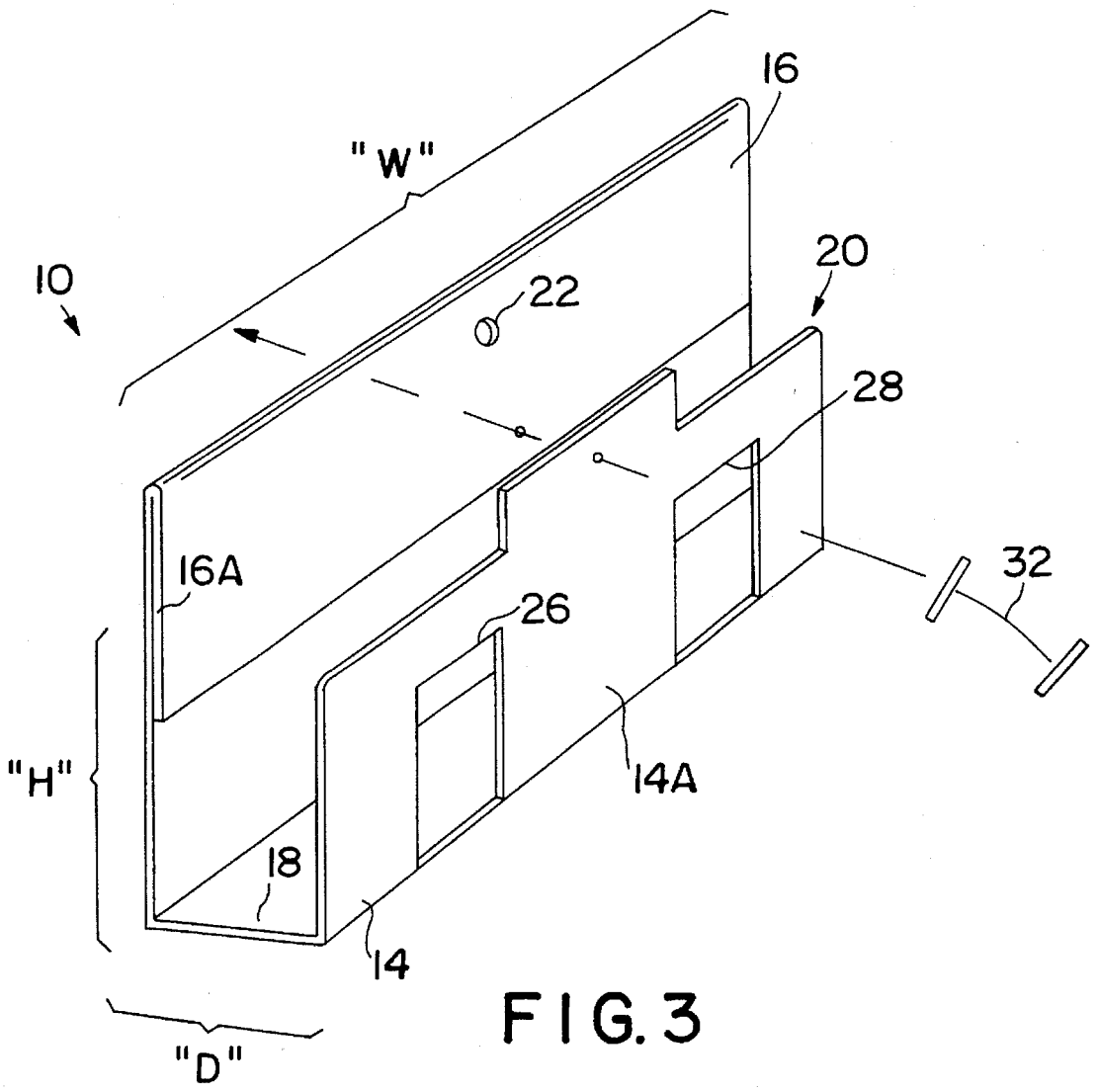
FIG. 3 is a perspective view of the garment display package with the socks removed for clarity.

As best shown in FIGS. 2 and 3, the package 10 is preferably constructed of a web of card stock folded to define spaced apart front and back walls 14 and 16, and a bottom wall 18. Preferably, the web is formed of 20 point SBS board with matte varnish.

The walls 14, 16, and 18 define an open top and open sides, and collectively form a partially enclosed, garment receiving opening 20 within which the socks "S" are placed for display. Alternatively, the package may include an open-ended, clear plastic tube (not shown) for holding and displaying the socks.

The garment receiving opening 20 has a width defined by the dimension of the walls 14 and 16 substantially equal to or greater than its height. The height of the opening 20 is defined herein as the distance extending from the bottom wall 18 of the package 10 upwardly towards the top of the front wall 14 necessary to accommodate a single pair of socks "S". For example, the height of the opening 20 may be between 6–12 cm, and the width of the opening 20 between 15–30 cm. Preferably, the width of the opening 20 is at least twice as great as the height of the opening 20. The depth of the opening 20 is defined by the dimension of the bottom wall 18 extending between walls 14 and 16, and is preferably between 3–5 cm. The height, width, and depth of the opening 20 are indicated respectively in FIG. 3 by brackets labeled "H", "W", and "D".

The bottom wall 18 allows the package 10 to stand upright on a flat surface, such as a display shelf or table. The user may thus effectively display the package 10 on the flat surface together with other merchandise, such as athletic shoes or the like.

The back wall 16 of the package 10 preferably extends above the front wall 14, and includes a prong-receiving hole 22 formed in the widthwise dimension "W" of the back wall 16 for hanging the package 10 from a vertical support structure, such as a wire rack, peg board, or other conventional means. The package 10 may thus be displayed and merchandized on either a flat surface, as described above, or hung from a support structure.

In an alternative embodiment, the package 10 is hung for display by a plastic hook or other suitable hanging means attached to the back wall 16 or to the front wall 14 of the package 10. In yet another embodiment, the package 10 includes a top wall (not shown), and hanging means attached to the top wall.

Preferably, the back wall 16 of the package 10 further includes a reinforcing section 16A created by an extra fold in the web, as shown in FIG. 2. The reinforcing section 16A strengthens the back wall 16, and protects the package 10 from damage when handled by users.

The front wall 14 of the package 10 includes first and second, laterally spaced display windows 26 and 28 for providing further display of the socks "S" in the package 10. An enlarged center section 14A separates the display windows 26 and 28, and is especially usable for communicating written material such as trademarks and advertising. A plastic T-bar anchor 32 is passed through the center section 14A, the socks "S" and the back wall 16 for interconnecting the front and back walls 14 and 16 and to securely hold the socks "S" in the package 10.

Figure 4:
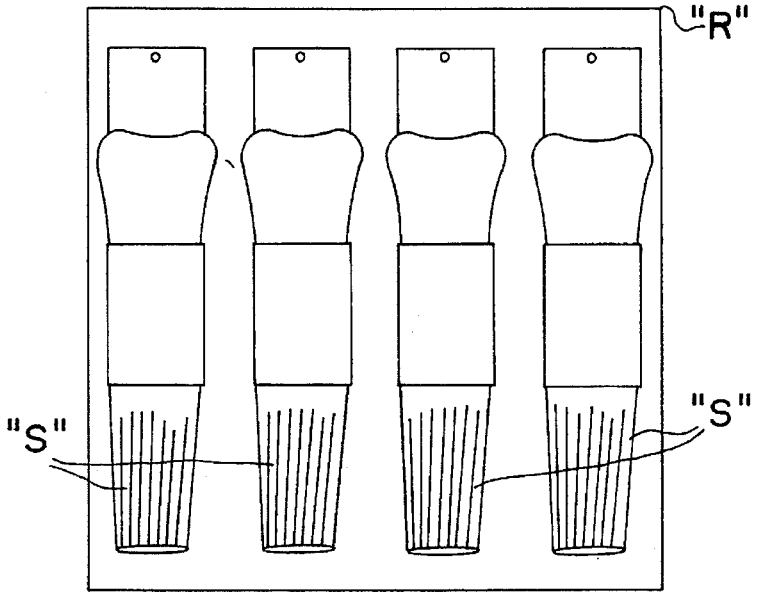
FIG. 4 PRIOR ART
FIG. 4 is a front elevation of a display rack displaying a number of like packages according to the prior art.
Figure 5:
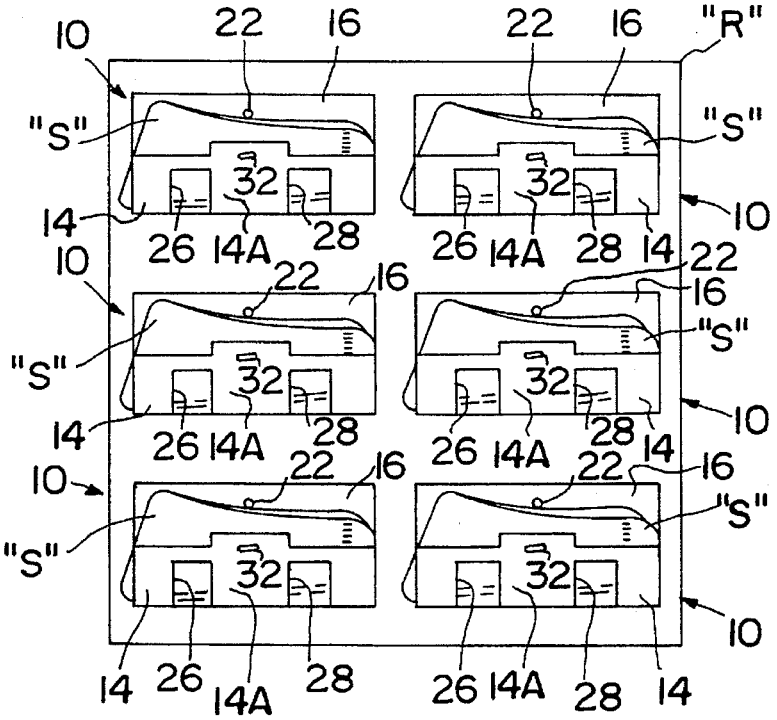
FIG. 5 is a front elevation of a display rack having the same display area in FIG. 4, and displaying a larger number of packages according to the present invention.

Referring to FIGS. 4 and 5, a greater number of packages 10 may be displayed from a standard wire rack "R" within a predefined display area, as compared to conventional, prior art packages "P". As shown in FIG. 4, since it is generally most desirable to display a relatively large portion of the sock when packaged, the socks "S" of the prior art package "P" are commonly folded at the heel to lengthen the display. Thus, a greater portion of the socks "S" extend outwardly from open ends of the package "P". This increases the overall area required for the display.

As shown in FIGS. 1 and 5, the socks "S" contained in the package 10 are folded at the ankle, and thus provide a shorter display when packaged. The display windows 26 and 28 allow users to view and feel a relatively large portion of the socks "S" without lengthening the display by folding the socks "S" at the heel. Furthermore, because the walls 14 and 16 of the package 10 compress the socks "S" more packages 10 may be placed depthwise on the wire rack "R" within the display area, as compared to the prior art package "P".

Figure 6:
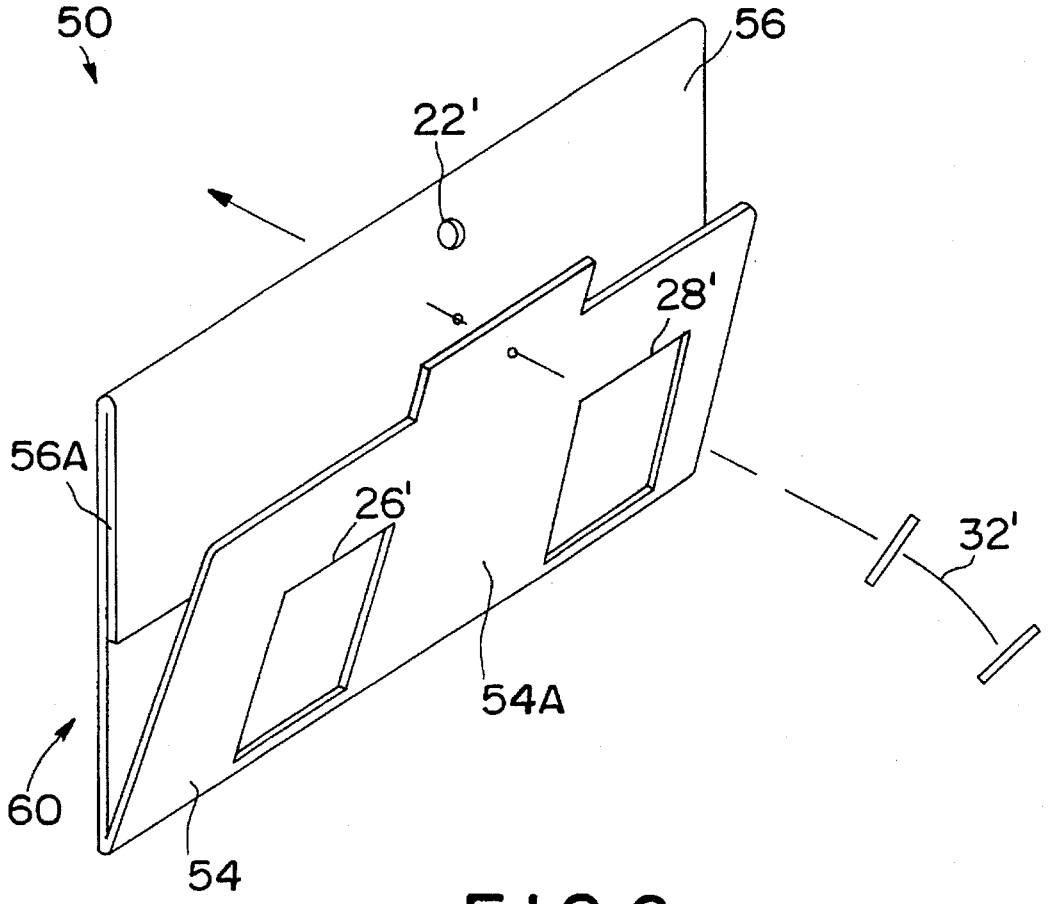
FIG. 6 is a perspective view of the garment display package according to a second preferred embodiment of the invention.
Figure 7:
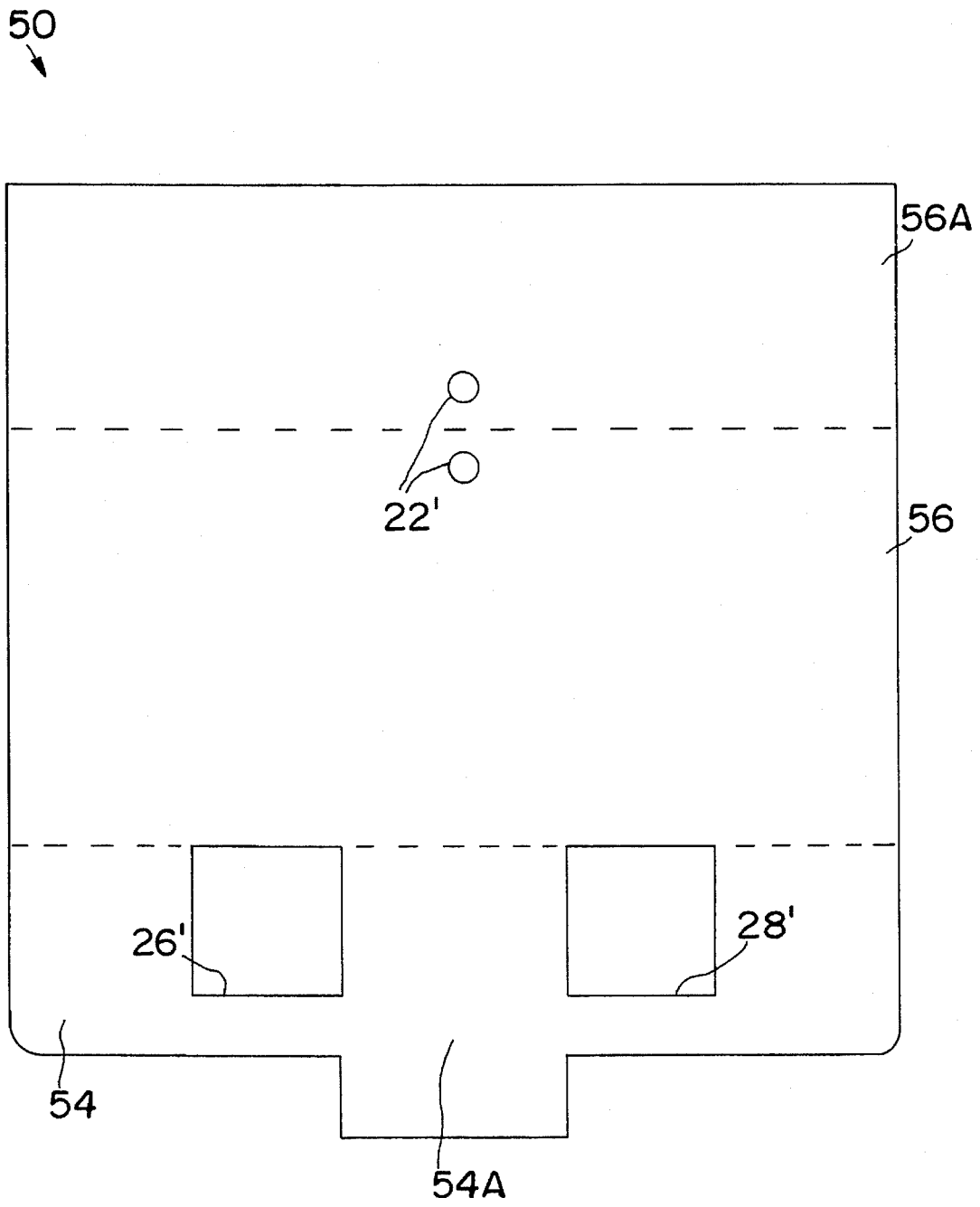
FIG. 7 is a plan view of the web according to the second embodiment, and prior to folding.

An alternative embodiment of the display package 50 is illustrated in FIGS. 6 and 7. The package 50 is constructed of a card stock web folded to define spaced apart front and back walls 54 and 56 for locating a pair of socks therebetween. The front wall 54 includes and enlarged center section 54A. The back wall includes a reinforcing section 56A. The front and back walls 54 and 56 together form a garment receiving opening 60 within which the socks are placed for display. Like elements described above with reference to the package 10 are illustrated in prime notation in FIGS. 6 and 7.

The packages 10 and 50 may used for displaying other garments, such as hosiery, undergarments, leggings, and the like. In addition, the walls of the package may be separately attached together using any suitable means, and may be used for providing written information regarding size, care, and fitting of the socks. For added printing space, the back wall of the package may be formed to extend substantially higher than the front wall.

A garment display package and method is described above. Various details of the invention may be changed without departing from its scope. Furthermore, the foregoing description of the preferred embodiment of the invention is provided for the purpose of illustration only and not for the purpose of limitation—the invention being defined by the claims.

I claim:

1. A garment display package comprising:

(a) a web folded to define a bottom wall and spaced-apart front and back walls for locating a garment therebetween, each of said front and back walls defining a height and width;

(b) the bottom, front, and back walls collectively forming a single, U-shaped garment receiving opening having a width greater than its height and extending without interruption the entire width of the web; and (c) a hanger located on a widthwise dimension of the back wall for hanging the package from a supporting structure for display.

2. A garment display package according to claim 1, wherein the width of said garment receiving opening is at least twice as great as the height of the opening.

3. A garment display package according to claim 1, wherein the bottom, front, and back walls define an open top and open sides.

4. A garment display package according to claim 1, wherein the back wall of the package extends above the front wall, and includes a reinforcing section for being handled by users.

5. A garment display package according to claim 1, wherein the front wall of the package defines at least one display window therein for providing further display of the garment in the package.

6. A garment display package according to claim 1, wherein the front wall of the package defines first and second laterally spaced display windows therein for providing further display of the garment in the package.

7. A garment display package according to claim 6, wherein the front wall of the package includes an enlarged center section located between the first and second display windows.

8. A garment display package according to claim 7, and including an anchor secured to the center section of the front wall and to the back wall of the package for interconnecting the front and back walls of the package.

9. A garment display package according to claim 1, wherein the bottom wall of the package defines a flat surface for locating the package upright on a supporting surface for display.

10. A garment display package according to claim 1, wherein said hanger comprises a prong-receiving hole formed in the back wall of the package.

11. A garment display package comprising:

(a) a web folded to define spaced-apart front and back walls for locating a garment therebetween, each of said front and back walls defining a height and width;

(b) the front and back walls forming therebetween a single, V-shaped garment receiving opening having a width greater than its height and extending without interruption the entire width of the web; and (c) a hanger located on a widthwise dimension of the back wall for hanging the package from a supporting structure for display.

12. A garment display package according to claim 11, wherein the width of said garment receiving opening is at least twice as great as the height of the opening.

13. A garment display package according to claim 11, wherein the front wall of the package defines first and second laterally spaced display windows therein for providing further display of the garment in the package.

14. A garment display package according to claim 11, wherein the front and back walls define an open top and open sides.

15. A garment display package according to claim 1 or 11, and including an anchor secured to the front wall and to the back wall of the package for interconnecting the front and back walls of the package.

16. A garment display package according to claim 15, wherein said anchor is secured to the front wall and the back wall in a position to extend through the garment to secure the garment in the package.

17. A garment display package comprising:

(a) a web folded to define a bottom wall and spaced-apart front and back walls for locating a garment therebetween;

(b) the bottom, front, and back walls collectively forming a garment receiving opening having a width greater than its height;

(c) a hanger located on a widthwise dimension of the back wall for hanging the package from a supporting structure for display:

(d) the front wall of the package defining first and second laterally spaced windows therein for providing further display of the garment in the package; and (e) the front wall of the package including an enlarged center section located between the first and second display windows.

18. A garment display package according to claim 17, and including an anchor secured to the center section of the front wall and to the back wall of the package for interconnecting the front and back walls of the package.

19. A garment display package according to claim 17, wherein said anchor is secured to the front wall and the back wall in a position to extend through the garment to secure the garment in the package.

* * * * *